US008002276B2

(12) United States Patent
Ishikawa et al.

(10) Patent No.: US 8,002,276 B2
(45) Date of Patent: Aug. 23, 2011

(54) SHEET CONVEYANCE DEVICE

(75) Inventors: Misato Ishikawa, Yokohama (JP); Yasuo Shima, Kawasaki (JP); Masaki Takahashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 137 days.

(21) Appl. No.: 12/356,922

(22) Filed: Jan. 21, 2009

(65) Prior Publication Data

US 2009/0184461 A1 Jul. 23, 2009

(30) Foreign Application Priority Data

Jan. 22, 2008 (JP) ..... 2008-011721

(51) Int. Cl.
*B65H 5/36* (2006.01)
*B65H 3/66* (2006.01)

(52) U.S. Cl. ..... 271/242; 271/161; 271/902

(58) Field of Classification Search ..... 271/242, 271/902, 161

See application file for complete search history.

(56) References Cited

U.S. PATENT DOCUMENTS 5,417,415 A * 5/1995 Murakami ..... 271/227

FOREIGN PATENT DOCUMENTS

| | | | |
|---|---|---|---|
| JP | 04153134 A | * | 5/1992 |
| JP | 07-309476 | | 11/1995 |
| JP | 08-026526 | | 1/1996 |
| JP | 2000168995 A | * | 6/2000 |
| JP | 2005082355 A | * | 3/2005 |
| JP | 2007302381 A | * | 11/2007 |
| JP | 2007331920 A | * | 12/2007 |

* cited by examiner

*Primary Examiner* — Stefanos Karmis
*Assistant Examiner* — Luis A Gonzalez
(74) *Attorney, Agent, or Firm* — Turocy & Watson, LLP

(57) ABSTRACT

A sheet conveyance device includes: a first conveyance member configured to convey a sheet in a first direction; a second conveyance member configured to convey the sheet in a second direction; a guide disposed between the first conveyance member and the second conveyance member, the guide having a curved face configured to guide the sheet conveyed from the first conveyance member to the second conveyance member; and an adjustment member disposed at an inner position of the curvature of the curved face of the guide, the adjustment member being configured to swing to contact with a curved inner face of the sheet guided by the guide in accordance with a contact force applied by the sheet.

6 Claims, 9 Drawing Sheets

SHEET CONVEYANCE DEVICE

RELATED APPLICATION(S)

The present disclosure relates to the subject matters contained in Japanese Patent Application No. 2008-011721 filed on Jan. 22, 2008, which are incorporated herein by reference in its entirety.

FIELD

The present invention relates to a sheet conveyance device which conveys a sheet to an image forming section of an image forming apparatus such as a multi function peripheral (hereinafter abbreviated to as MFP) or a printer and to an image forming apparatus equipped with the sheet conveyance device. The present invention relates to a sheet conveyance device and an image forming apparatus which can convey various types of sheets using the same conveyance path.

BACKGROUND

In an image forming apparatus such as an MFP and a printer, it is necessary to align the position of a sheet fed from a sheet feeding cassette or a manual sheet feeding tray before conveyance of the sheet to an image forming section in order to obtain high image quality without displacement of an image and without color shift of the image. For the position alignment of the sheet, in most cases, registration rollers are generally provided in a sheet conveyance path to perform positioning and skew correction of the sheet.

When the sheet is fed from the sheet feeding tray to the registration rollers, the registration rollers suspend their rotation and collide with a leading end of the sheet to thereby align the position of the sheet. Then, the registration rollers resume their rotation so that the sheet is conveyed to the image forming section so as to be synchronized with an image formed in the image forming section.

On the other hand, in an image forming apparatus installed in a quiet environment such as an office, it is necessary to reduce noise generated during the operation of the image forming apparatus as sufficiently as possible, so that there is an attempt to reduce noise generated at the time of conveying and positioning the sheet. Therefore, there has been heretofore an apparatus including an elastic guide provided in a curved conveyance path for guiding a sheet to a pair of registration rollers, the elastic guide having an end portion coming into contact with the sheet, the end portion being bent toward a sheet feeding direction to adjust contact between the sheet and the end portion of the guide to thereby reduce noise at the time of registration. An example of such conventional apparatus is disclosed in JP-A-8-026526.

According to the conventional apparatus configured as described in the document, JP-A-8-026526, it is possible to reduce noise generated by contact between the sheet and the end portion of the guide before the sheet reaches the pair of registration rollers and it is also possible to achieve reduction of paper dust produced by the contact. In the sheet conveyance device of the conventional apparatus, however, collision noise is also generated when a leading end of the sheet hits the suspended registration rollers. Particularly in the case where the sheet was stiff and thick, there was a problem that louder collision noise occurred when the sheet collided with the suspended registration rollers.

SUMMARY

According to a first aspect of the invention, there is provided a sheet conveyance device including: a first conveyance member configured to convey a sheet in a first direction; a second conveyance member configured to convey the sheet in a second direction; a guide disposed between the first conveyance member and the second conveyance member, the guide having a curved face configured to guide the sheet conveyed from the first conveyance member to the second conveyance member; and an adjustment member disposed at an inner position of the curvature of the curved face of the guide, the adjustment member being configured to swing to contact with a curved inner face of the sheet guided by the guide in accordance with a contact force applied by the sheet.

According to a second aspect of the invention, there is provided an image forming apparatus including: an image forming section configured to form an image on a sheet; and a sheet conveyance device including: a first conveyance member configured to convey the sheet in a first direction; a second conveyance member configured to convey the sheet in a second direction; a guide disposed between the first conveyance member and the second conveyance member, the guide having a curved face configured to guide the sheet conveyed from the first conveyance member to the second conveyance member; and an adjustment member disposed at an inner position of the curvature of the curved face of the guide, the adjustment member being configured to swing to contact with a curved inner face of the sheet guided by the guide in accordance with a contact force applied by the sheet.

BRIEF DESCRIPTION OF THE DRAWINGS

A general configuration that implements the various feature of the invention will be described with reference to the drawings. The drawings and the associated descriptions are provided to illustrate embodiments of the invention and not to limit the scope of the invention.

FIGS. 4A to 4C are schematic explanatory views showing occurrence of collision noise in the registration mechanism in the first embodiment of the invention, in which FIG. 4A shows contact between a sheet and a stationary guide, FIG. 4B shows contact between the sheet and one of registration rollers, and FIG. 4C shows contact between the sheet and a nip portion between the registration rollers.

FIGS. 6A to 6C are schematic explanatory views showing a state in which a thick sheet is conveyed in the registration and conveyance guide according to the first embodiment of the invention, in which FIG. 6A shows contact between the sheet and the stationary guide, FIG. 6B shows rotation of the rotary guide caused by the sheet, and FIG. 6C shows collision between the sheet and the nip portion between the registration rollers.

FIGS. 13A and 13B are schematic explanatory views showing a state in which a thick sheet is conveyed in a registration and conveyance guide according to a third modification of the invention, in which FIG. 13A shows contact between the sheet and the stationary guide, and FIG. 13B shows the rotary guide rotated by the sheet.

DETAILED DESCRIPTION OF THE EMBODIMENTS

Figure 1:
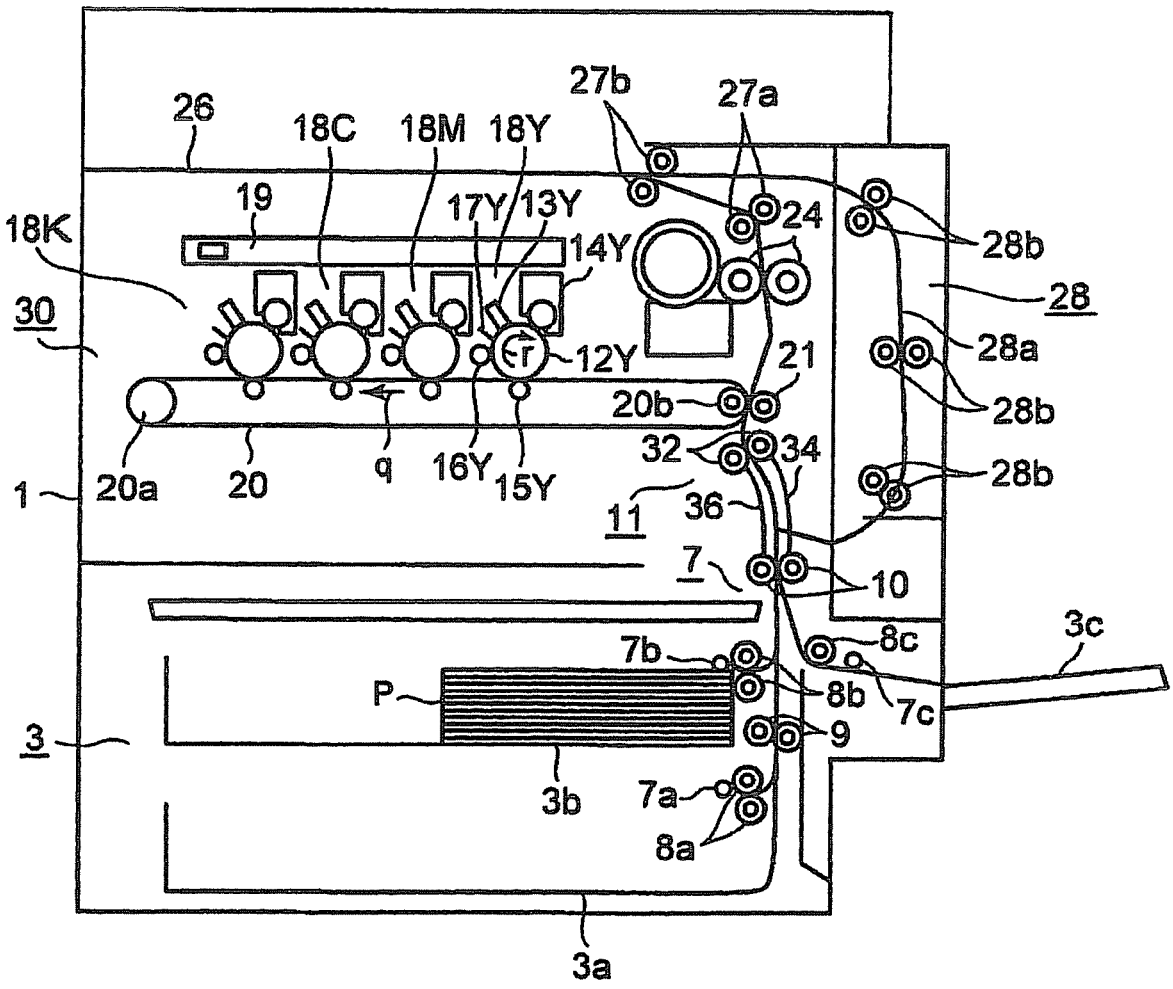
FIG. 1 is a schematic configuration view showing an image forming apparatus according to a first embodiment of the invention.

Hereinafter, embodiments of the invention will be described. In the following description, the same or similar components will be referenced by the same reference numerals, and detailed description thereof will be omitted.

In a sheet conveyance device according to the invention, an adjustment member which swings by contacting a sheet is disposed in a curved guide which guides the sheet to a pair of registration rollers.

First Embodiment

A first embodiment of the invention will be described below in detail with reference to FIGS. 1 to 8. FIG. 1 is a schematic configuration view showing a quad-tandem type image forming apparatus 1 equipped with a sheet conveyance device according to the invention. The image forming apparatus 1 includes an image forming section 30, and a sheet feeding tray 3 provided under the image forming section 30. The sheet feeding tray 3 feeds a sheet P to the image forming section 30. The sheet feeding tray 3 has a first sheet feeding cassette 3*a*, a second sheet feeding cassette 3*b*, and a manual sheet feeding tray 3*c*. Each of the sheet feeding cassettes 3*a* and 3*b* and the manual sheet feeding tray 3*c* is configured to accommodate a stack of sheets P. Pickup rollers 7*a*, 7*b* and 7*c*, separation and conveyance rollers 8*a*, 8*b* and 8*c*, transmission rollers 9, a pair of conveyance rollers 10 and a registration mechanism 11 are provided in a conveyance path 7 which leads from the sheet feeding cassettes 3*a* and 3*b* and the manual sheet feeding tray 3*c* to the image forming section 30. Each of the pickup rollers 7*a*, 7*b* and 7*c* picks up one sheet from corresponding one of the sheet feeding cassettes 3*a* and 3*b* and the manual sheet feeding tray 3*c*. The conveyance rollers 10 are provided as a first conveyance member. The registration mechanism 11 will be described later.

For example, the image forming section 30 has respective color image forming stations 18Y, 18M, 18C and 18K of yellow (Y), magenta (M), cyan (C) and black (K). The respective color image forming stations 18Y, 18M, 18C and 18K are arranged in tandem along an endless transfer belt 20. The transfer belt 20 is stretched between a drive roller 20*a* and a driven roller 20*b* so that the transfer belt 20 can be rotated in a direction shown by an arrow q in FIG. 1. A secondary transfer roller 21 is provided in a secondary transfer position supported by the driven roller 20*b* of the transfer belt 20 so that the secondary transfer roller 21 is disposed opposite to the driven roller 20*b*. In the secondary transfer position, a toner image on the transfer belt 20 is secondarily transferred onto a sheet P based on a transfer bias supplied from the secondary transfer roller 21.

A fixing unit (a fuser) 24 is provided on a downstream side of the image forming apparatus 1 with respect to the secondary transfer position. A pair of sheet discharging rollers 27*a* and a pair of discharged sheet reversing rollers 27*b* are further provided on a downstream side of the fixing unit 24. The pair of sheet discharging rollers 27*a* discharge the sheet P to a sheet discharging portion 26 after the toner image is fixed on the sheet P. The image forming apparatus 1 further has a reverse conveyance unit 28 for reversing the sheet P for formation of images on opposite sides of the sheet P. The reverse conveyance unit 28 includes a reverse guide 28*a*, and pairs of reverse conveyance rollers 28*b*. The reverse guide 28*a* guides the sheet P to the registration mechanism 11.

The yellow (Y) image forming station 18Y has a photoconductor drum 12Y, an charging unit 13Y, a development unit 14Y, a transfer roller 15Y, a cleaner 16Y, and an electrostatic eliminator 17Y. The photoconductor drum 12Y is an image carrier which rotates in a direction of an arrow r. These parts 13Y to 17Y are disposed around the photoconductor drum 12Y. A laser beam exposure unit 19 is provided above the yellow (Y) image forming station 18Y. The laser beam exposure unit 19 irradiates the photoconductor drum 12Y with a laser beam.

Each of the color image forming stations 18M, 18C and 18K of magenta (M), cyan (C) and black (K) has the same configuration as the yellow (Y) image forming station 18Y, so that description thereof will be omitted.

In the image forming section 30, the yellow (Y) image forming station 18Y works in accordance with the start of a printing operation so that the photoconductor drum 12Y rotates in the direction of the arrow r and is charged uniformly with static electricity by the charging unit 13Y. Then, the laser beam exposure device 19 irradiates the photoconductor drum 12Y with an exposure laser beam corresponding to image information to thereby form an electrostatic latent image on the photoconductor drum 12Y.

Then, the electrostatic latent image on the photoconductor drum 12Y is developed into a toner image by the development unit 14Y. After the development, the toner image formed on the photoconductor drum 12Y is primarily transferred onto the transfer belt 20 in the position of the transfer roller 15Y. After completion of the transfer, the photoconductor drum 12Y is cleaned by the cleaner 16Y to remove residual toner from the photoconductor drum 12Y, and static electricity is eliminated from the surface of the photoconductor drum 12Y by the electrostatic eliminator 17Y. In this manner, preparation for a next printing operation is completed.

Each of the color image forming stations 18M, 18C and 18K of magenta (M), cyan (C) and black (K) performs an image forming operation in the same manner as the yellow (Y) image forming station 18Y. Toner images formed on the respective photoconductor drums are primarily transferred on the transfer belt 20 so as to be superimposed on one another, so that a full color toner image is formed on the transfer belt 20.

When the full color toner image formed on the transfer belt 20 then reaches the secondary transfer position, the full color toner image is secondarily transferred onto the sheet P in a batch processing manner by a transfer bias of the secondary transfer roller 21. When this occurred, the sheet P is fed to the registration mechanism 11 from the sheet feeding tray 3 so that the sheet P reaches the secondary transfer position in synchronization with the time when the full color toner image on the transfer belt 20 reaches the secondary transfer position. The sheet P having the transferred full color toner image thereon is then heated and pressed by the fixing unit 24 so that the full color toner image is fixed on the sheet P. Thus, the print image on the sheet P is completed and then the sheet P is discharged to the sheet discharging portion 26. When the printing operation is a double-side printing operation, a printing operation for a second surface of the sheet P is performed after a print image on a first surface of the sheet P is completed via the fixing unit 24. For the printing operation for the second surface, the sheet P is conveyed to the reserve conveyance unit 28 side by the pair of discharged paper reversing rollers 27*b* and fed to the registration mechanism 11 again.

Figure 2:
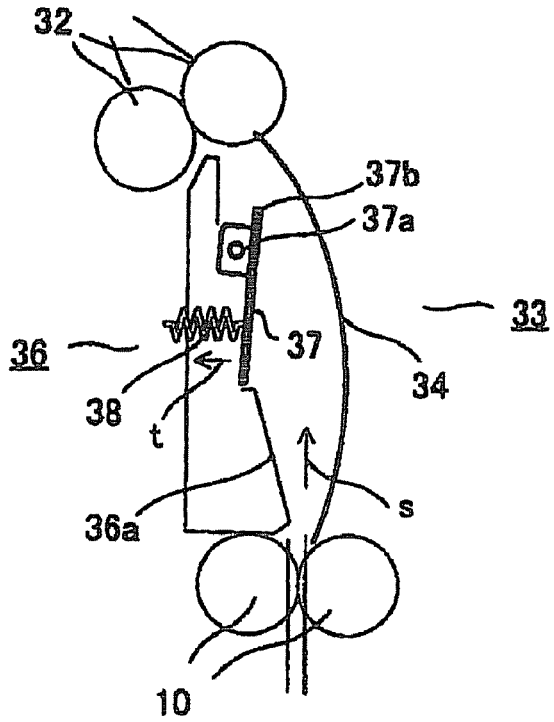
FIG. 2 is a schematic configuration view showing a registration mechanism according to the first embodiment of the invention.

The registration mechanism 11 will be described below. As shown in FIG. 2, the registration mechanism 11 is provided between the pair of conveyance rollers 10 and the secondary transfer roller 21. The registration mechanism 11 has a pair of registration rollers 32 serving as a second conveyance member, and a registration and conveyance guide 33 as a guide. The pair of registration rollers 32 suspend their rotation under control of a drive control portion not shown, and then resume their rotation after the leading end of the sheet P conveyed by the pair of conveyance rollers 10 hits the pair of registration rollers 32. In this manner, the sheet P is fed to the secondary transfer position in synchronization with the time when the toner image reaches the secondary transfer position in the image forming section 30.

Figure 3:
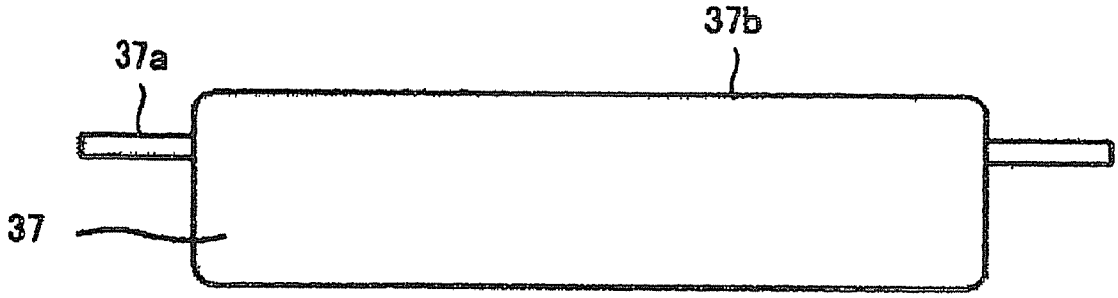
FIG. 3 is a schematic plan view showing a rotary guide according to the first embodiment of the invention.

The registration and conveyance guide 33 has a stationary guide 34, and a movable guide portion 36. The stationary guide 34 is curved concavely toward the sheet P. The movable guide portion 36 has a support guide 36*a*, and a rotary guide 37 serving as an adjustment member. The rotary guide 37 is attached to the support guide 36*a* so that the rotary guide 37 can rotate. As shown in FIG. 3, the rotary guide 37 is shaped like a flat plate. The rotary guide 37 is rotated on an attachment shaft 37*a* attached to the support guide 36*a*, and pulled in a direction of an arrow t as a direction of the support guide 36*a* by a spring 38 on an upstream side with respect to a direction of an arrow s as the direction of conveyance of the sheet P. A free end 37*b* of the rotary guide 37 protrudes onto a traveling path of the sheet P so as to come into contact with an inner face of the sheet P traveling concavely in the registration and conveyance guide 33.

Figure 4A:
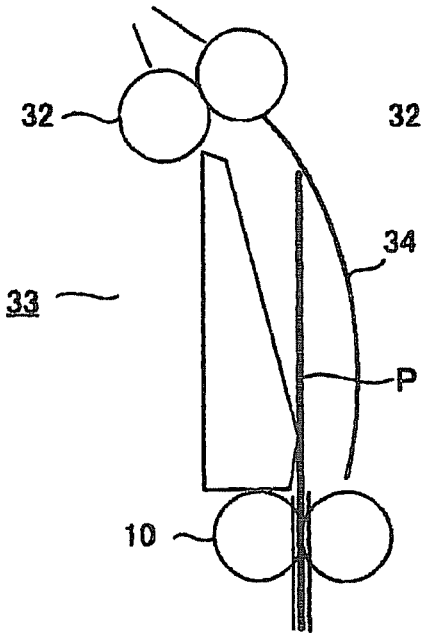
Figure 4B:
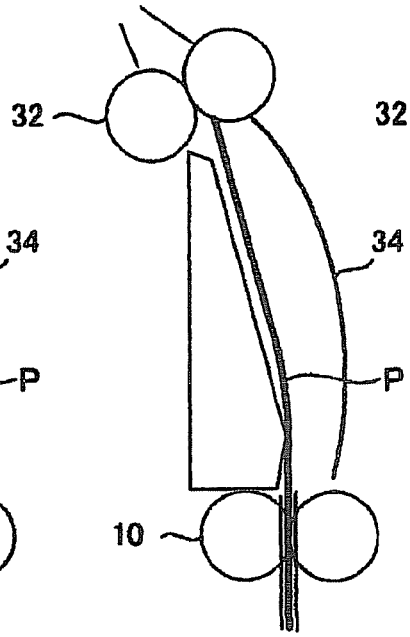
Figure 4C:
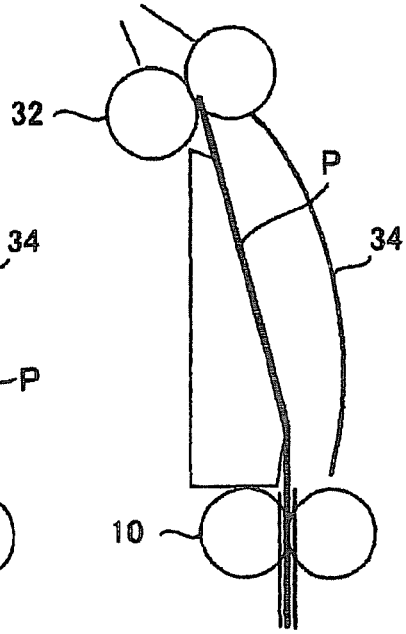
Figure 5:
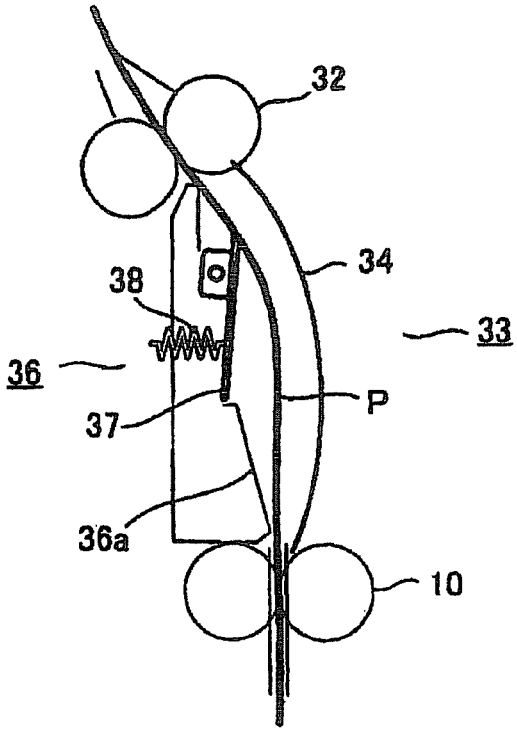
FIG. 5 is a schematic explanatory view showing a state in which a PPC sheet is conveyed in a registration and conveyance guide according to the first embodiment of the invention.

Generally, a leading end of the sheet P traveling in the registration and conveyance guide 33 first hits the stationary guide 34, as shown in FIG. 4A. Then, the sheet P moves toward the registration rollers 32 along the stationary guide 34 based on a conveyance force of the pair of conveyance rollers 10 and hits one of the suspended registration rollers 32, as shown in FIG. 4B. The sheet P further moves forward along the registration rollers 32 and collides with a nip portion between the registration rollers 32, as shown in FIG. 4C. Then, the pair of conveyance rollers 10 suspend their conveyance operation after conveyance is continued for a predetermined time so that the sheet P is warped slightly. When this occurred, the posture of the sheet P is adjusted by the stiffness (restoring force) of the warped sheet P, so that the skew of the sheet P is corrected.

After the sheet P operating as described above hits the stationary guide 34 as shown in FIG. 4A, the sheet P further moves forward while sliding on the surface of the stationary guide 34. After the sheet P then hits one of the registration rollers 32 as shown in FIG. 4B, the sheet P moves forward while sliding on the surface of the registration roller 32. Accordingly, loud collision noise is not generated even if the sheet P is heavy in grammage (weight per square meter) and thick. However, when the leading end portion of the sheet P collides with the nip portion between the suspended registration rollers 32 as shown in FIG. 4C, collision noise is generated. This collision noise will become loud particularly when the sheet P is thick. For this reason, in this embodiment, the rotary guide 37 is brought into contact with the sheet P to suppress minute vibration of the sheet P at the time of collision to thereby reduce collision noise. In addition, the rotary guide 37 further pushes up the concavely curved inner face of the sheet P to increase the curvature of the concavely curved inner face of the sheet P (i.e. increase the flexure of the sheet P) to change the angle of approach of the sheet P to the nip portion between the registration rollers 32 to thereby reduce collision noise.

The behavior of the sheet conveyance device according to the invention will be described below. When an image formation operation starts, the image forming section 30 in the image forming apparatus 1 forms a full color toner image on the transfer belt 20. On the other hand, the sheet feeding tray 3 in the image forming apparatus 1 feeds a sheet from any one of the first sheet feeding cassette 3*a*, the second sheet feeding cassette 3*b* and the manual sheet feeding tray 3*c* and feeds the sheet to the pair of conveyance rollers 10. Then, in the registration mechanism 11, the sheet P is guided by the registration and conveyance guide 33 and positioned by the registration rollers 32. Then, the sheet P is conveyed to the secondary transfer position in synchronization with the time when the full color toner image on the transfer belt 20 reaches the second transfer position.

Incidentally, the traveling path of the sheet P in the registration and conveyance guide 33 can be changed in accordance with the type of the sheet (e.g. in accordance with the grammage of the sheet). While the sheet P is conveyed in the registration and conveyance guide 33, the sheet P contacts with the free end 37*b* of the rotary guide 37 regardless of the type of the sheet P. When this occurred, when the sheet P is a PPC sheet with a grammage, for example, of 64 ($g/m^2$) or a thin sheet pliable than the PPC sheet, the contact force of the sheet P with the rotary guide 37 is smaller than the tensile force of the spring 38 in the direction of the arrow t even if the sheet P contacts with the free end 37*b* of the rotary guide 37. Accordingly, the rotary guide 37 is not rotated, so that the sheet P is guided to the registration rollers 32 through a path shown in FIG. 5. Incidentally, When this occurred, the sheet P can be warped freely when the sheet P collides with the nip portion between the registration rollers 32, because the sheet P is pliable and light in grammage. Accordingly, minute vibration generated in the sheet P at the time of collision with the nip portion is absorbed by the warp of the sheet P and the contact between the sheet P and the free end 37*b* of the rotary guide 37, so that noise of the sheet P due to collision with the nip portion is suppressed to a considerably small value.

On the other hand, when the sheet P which is a stiff and thick sheet with a heavy grammage, for example, of 209 ($g/m^2$) contacts with the free end 37*b* of the rotary guide 37, the contact force of the sheet P with the rotary guide 37 becomes larger than the tensile force of the spring 38 in the direction of the arrow t so that the rotary guide 37 rotates in a direction of an arrow u regardless of the tensile force of the spring 38.

Figure 6A:
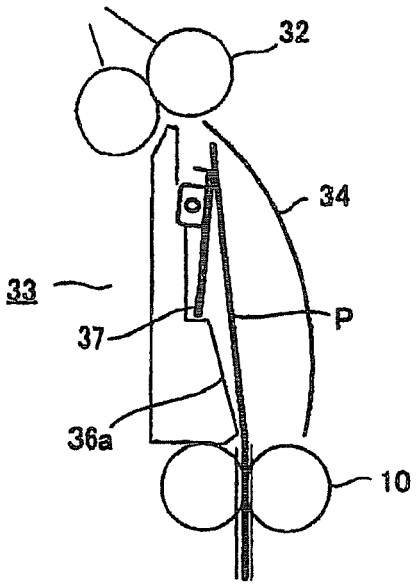
Figure 6B:
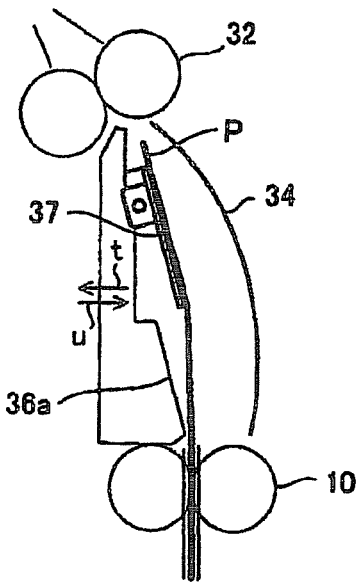
Figure 6C:
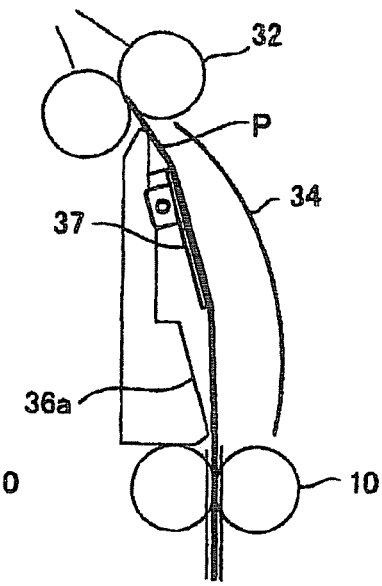

That is, as shown in FIG. 6A, the sheet P travels in the registration and conveyance guide 33 and hits the stationary guide 34. When this occurred, the sheet P contacts with the free end 37*b* of the rotary guide 37 to thereby rotate the rotary guide 37 in the direction of the arrow u. Thus, as shown in FIG. 6B, the angle of approach of the sheet P to the nip portion between the registration rollers 32 is changed so that the sheet P contacts with the almost whole surface of the rotary guide 37. In addition, the sheet P is pushed by an upstream-side end portion of the rotary guide 37 so that the traveling path of the sheet P is changed forcedly to increase the curvature of the concavely curved inner face of the sheet P (i.e. increase the warp of the sheet P). When the sheet P in this condition collides with the nip portion between the suspended registration rollers 32 as shown in FIG. 6C, minute vibration is generated in the sheet P. The vibration is however absorbed by the warp of the sheet P and the contact between the sheet P and the almost whole surface of the rotary guide 37. As a result, collision noise of the sheet P with the nip portion between the registration rollers 32 is suppressed to a small value even if the sheet P is a stiff and thick sheet.

Even after the aforementioned collision of the sheet P with the nip portion between the registration rollers 32, the sheet P is continuously conveyed for a predetermined time by the pair of conveyance rollers 10. In this manner, the sheet P is warped slightly in the registration and conveyance guide 33 to correct the skew of the sheet P in the position of the nip portion between the registration rollers 32 to thereby align the position of the sheet P. Then, the registration rollers 32 are rotated again so that the sheet P is fed to the secondary transfer position in synchronization with the time when the full color toner image on the transfer belt 20 reaches the secondary transfer position.

Then, the full color toner image on the transfer belt 20 is secondarily transferred onto the sheet P in a batch processing manner in the secondary transfer position and fixed on the sheet P by the fixing unit 24. Thus, the image formation operation is terminated.

The rotary guide 37 may be rotated without use of any spring. For example, the rotary guide 37 rotated by its contact force with the stiff sheet can be restored to its original position by its own weight as long as the center of gravity of the rotary guide 37 is located below the center of rotation of the rotary guide 37. In this case, the same effect as that due to use of such a spring can be obtained without provision of any spring.

Figure 7:
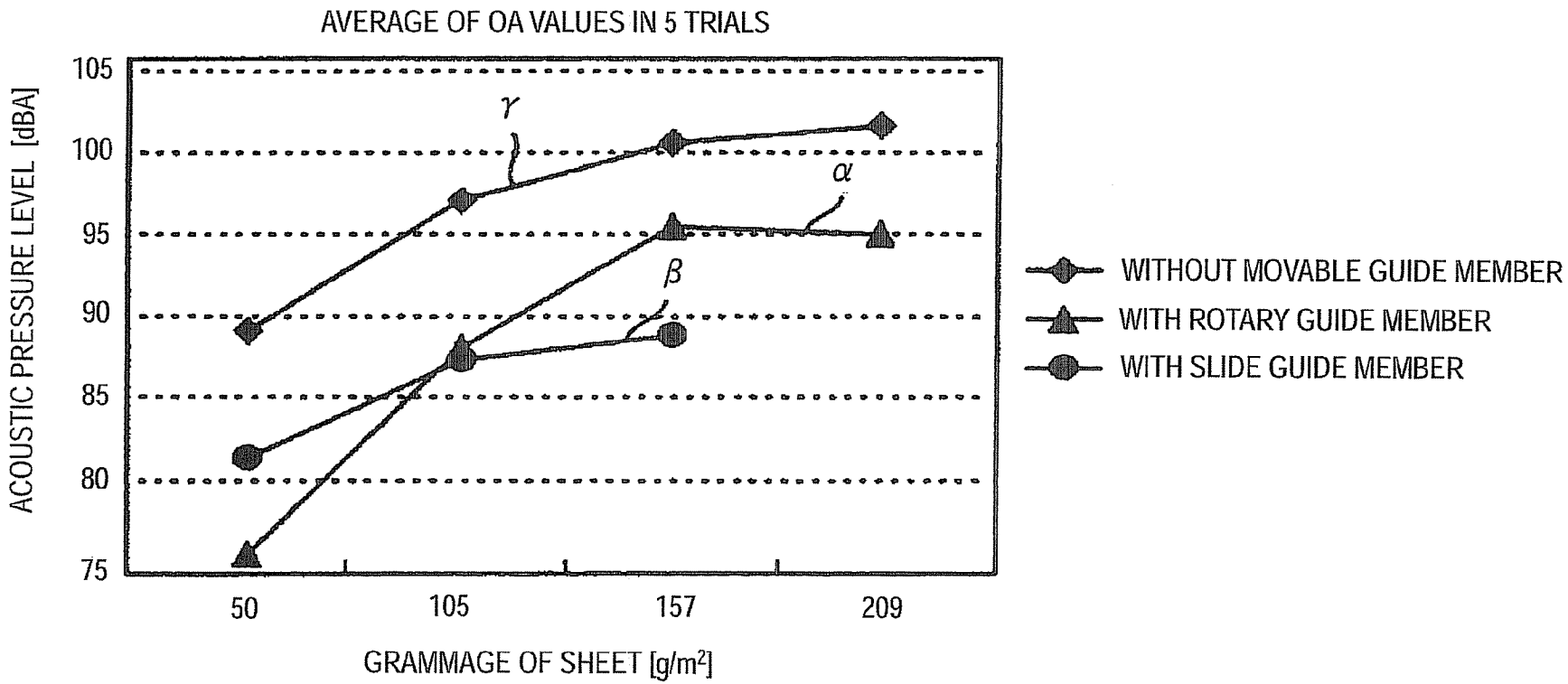
FIG. 7 is a graph showing test results of a control test using conveyance element test samples for comparing noise in first and second embodiments of the invention with noise in the background art.
Figure 8:
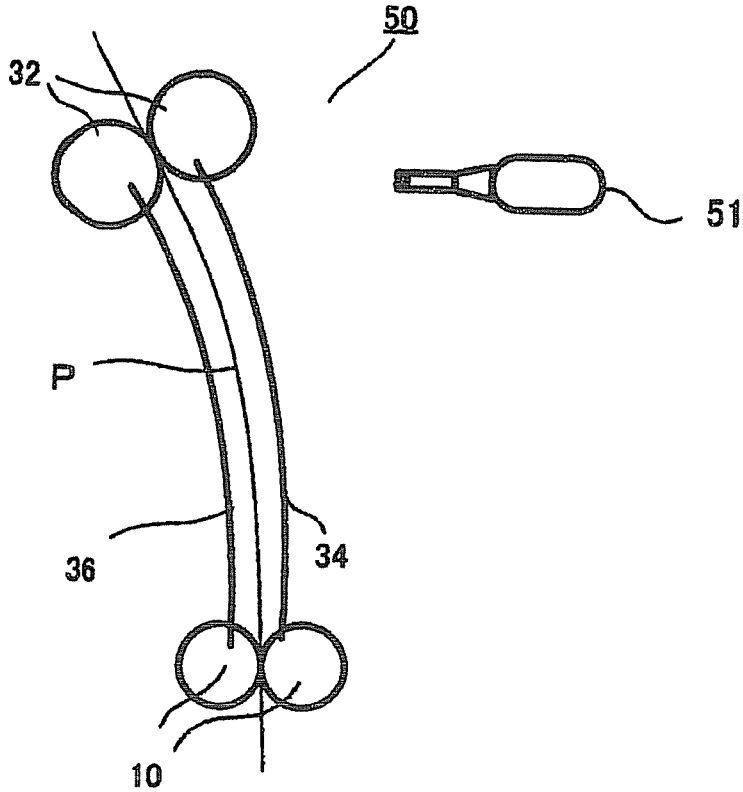
FIG. 8 is an explanatory view showing arrangement of a sound level meter for measuring the test results of FIG. 7.

A control test using a conventional conveyance element test sample without any rotary guide 37 as a control sample was performed on a conveyance element test sample having the registration mechanism 11 with the rotary guide 37 according to first embodiment and the conveyance rollers 10. FIG. 7 is a graph showing measured results of acoustic pressure levels [dBA]. Noise measurement was performed by a sound level meter (Rion Sound Level Meter NL-32, made by RION Co., Ltd.) 51 placed near the conveyance element test sample 50 as shown in FIG. 8. Sheets of paper P with grammage of 50, 105, 157 and 209 [g/m$^2$] were used in this test. In the condition that each sheet P was conveyed at a speed of 400 [mm/s] by the conveyance rollers 10 of the conveyance element test sample 50, collision noise generated at the time of collision of the sheet P with the nip portion between the registration rollers 32 was detected as an average of overall (OA) values for 80 [msec]. This noise measurement was regarded as a test result in the condition that the same sheet P in terms of grammage was conveyed five times. A new sheet was used for measurement which was performed five times on the same sheet.

The resulting acoustic pressure levels in the conveyance element test sample with the rotary guide 37 according to first embodiment as represented by the solid line a marked with black triangle in FIG. 7 were reduced remarkably compared with those in the conventional conveyance element test sample without the rotary guide 37 as represented by the solid line γ marked with black diamond in FIG. 7.

According to first embodiment, the rotary guide 37 is provided in the registration and conveyance guide 33 so that the rotary guide 37 can rotate in accordance with its contact force with the sheet P when the rotary guide 37 contacts with the concavely curved inner face of the sheet P. Hence, in accordance with the type of the sheet P, that is, when the sheet P is a stiff sheet such as a thick sheet, the curvature of the sheet P traveling in the registration and conveyance guide 33 is increased and the contact surface between the sheet P and the rotary guide 37 is increased so that vibration at the time of collision of the sheet P with the registration rollers 32 is absorbed. As a result, even when the position of a stiff sheet P is to be aligned in the registration mechanism 11 capable of feeding types of sheets of paper, collision noise of the sheet P with the registration rollers 32 can be reduced so that a quieter image forming apparatus 1 can be provided.

Second Embodiment

Figure 9:
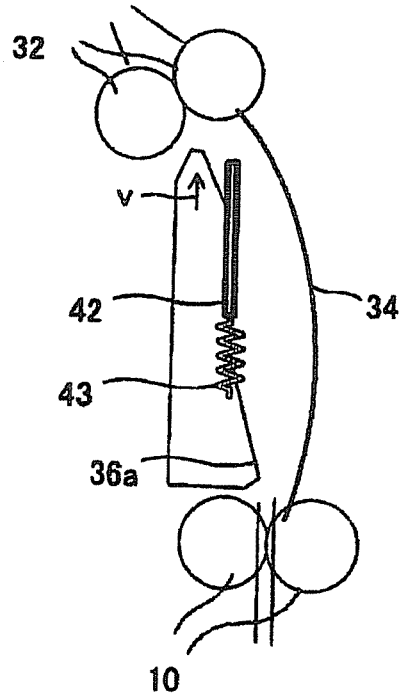
FIG. 9 is a schematic explanatory view showing a state in which a PPC sheet is conveyed in a registration and conveyance guide according to the second embodiment of the invention.
Figure 10:
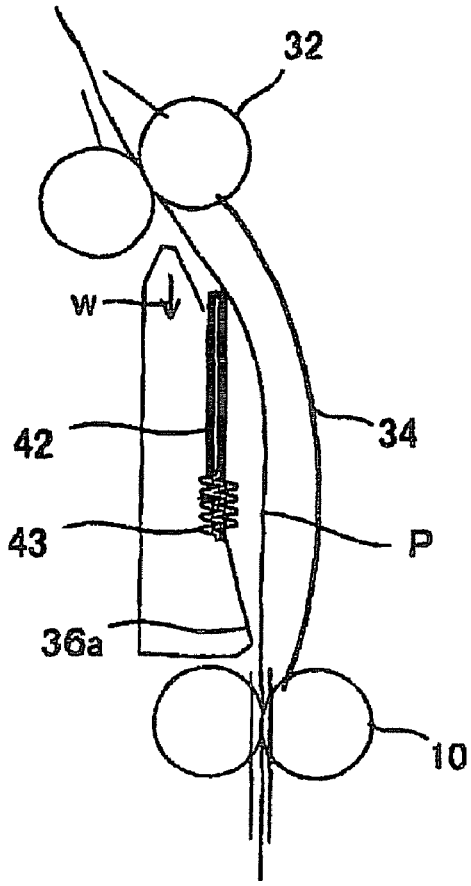
FIG. 10 is a schematic explanatory view showing a state in which a thick sheet is conveyed in the registration and conveyance guide according to the second embodiment of the invention.

A second embodiment of the invention will be described below with reference to FIGS. 9 and 10. The second embodiment is configured in the same manner as the first embodiment except that the adjustment member is different in structure. Accordingly, in the second embodiment, parts the same in configuration as those described in the first embodiment are referred to by the same numerals and detailed description thereof will be omitted.

In the apparatus according to the second embodiment, a slide guide 42 shaped like a flat plate and serving as an adjustment member is provided in the support guide 36*a* of the registration and conveyance guide 33 so that the slide guide 42 can swing. The slide guide 42 is pushed up in a direction of an arrow v by a second spring 43. Thus, in the state that the slide guide 42 is free, a gap between the stationary guide 34 and a leading end of the slide guide 42 is set to be as narrow as possible to restrict the traveling direction of the sheet P more accurately. As a result, the angle of approach of the sheet P to the nip portion between the registration rollers 32 is stabilized more sufficiently so that a good registration effect can be obtained. When the sheet P is a PPC sheet with a grammage, for example, of about 64 (g/m$^2$) or a sheet thinner than the PPC sheet, the second spring 43 has such an urging force that the second spring 43 is not contracted even when the second spring 43 contacts with the sheet P.

Accordingly, when the sheet P is a PPC sheet or a thin sheet pliable than the PCC sheet, the slide guide 42 is not pushed down while the sheet P is passing through the registration and conveyance guide 33. The sheet P passes through a path shown in FIG. 9 and the angle of approach of the sheet P to the nip portion between the registration rollers 32 is restricted more accurately so that the position of the sheet P is aligned better by the registration rollers 32. In addition, the sheet P is warped by the leading end of the slide guide 42 and minute vibration generated in the sheet P at the time of collision with the nip portion is absorbed by the contact between the sheet P and the leading end of the slide guide 42, so that collision noise of the sheet P with the nip portion is suppressed to a considerably small value.

In the registration and conveyance guide 33 using the slide guide 42 for setting the conveyance path of the sheet P to be as narrow as possible to restrict the sheet traveling direction more accurately, the load imposed on the sheet P by the slide guide 42 however becomes large when the fed sheet P is a stiff and thick sheet. For this reason, there is a possibility that, for example, a sheet P with a heavy grammage will not travel smoothly in the registration and conveyance guide 33 so that the position of the sheet P will not be aligned well and, accordingly, a sheet jam will occur.

In second embodiment, however, when the sheet P is a thick sheet, the slide guide 42 is pushed down by its contact force with the sheet P while the sheet P is passing through the registration and conveyance guide 33. As shown in FIG. 10, a sheet P with a grammage, for example, of 209 ($g/m^2$) pushes down the slide guide 42 in a direction of an arrow w to substantially expand the width between the stationary guide 34 and the leading end of the slide guide 42 to thereby reduce the load imposed on the sheet P by the slide guide 42.

A noise measurement test in the same condition as in first embodiment was performed on a conveyance element test sample having the registration mechanism 11 with the slide guide 42 according to second embodiment and the conveyance rollers 10. The resulting acoustic pressure levels in the conveyance element test sample with the slide guide 42 according to second embodiment as represented by the solid line β marked with black circle in FIG. 7 were reduced remarkably compared with those in the conventional conveyance element test sample without any rotary guide 37 as represented by the solid line γ marked with black diamond in FIG. 7.

According to second embodiment, the slide guide 42 is provided in the registration and conveyance guide 33 so that the slide guide 42 can swing in accordance with the contact force between the slide guide 42 and the concavely curved inner face of the sheet P. Hence, in accordance with the type of the sheet P, that is, when the sheet P is a PPC sheet or a thin sheet pliable than the PCC sheet, the slide guide 42 restricts the traveling direction of the sheet P more accurately to align the position of the sheet P better and suppress collision noise of the sheet P with the nip portion to a smaller value. On the other hand, when the sheet P is a stiff sheet such as a thick sheet, the slide guide 42 expands the traveling width of the sheet P to reduce the load imposed on the sheet P to thereby align the position of the sheet well and suppress collision noise of the sheet P with the nip portion. As a result, even when the position of a stiff sheet P is to be aligned in the registration mechanism 11 capable of feeding types of sheets of paper, a quieter image forming apparatus can be provided.

Figure 11:
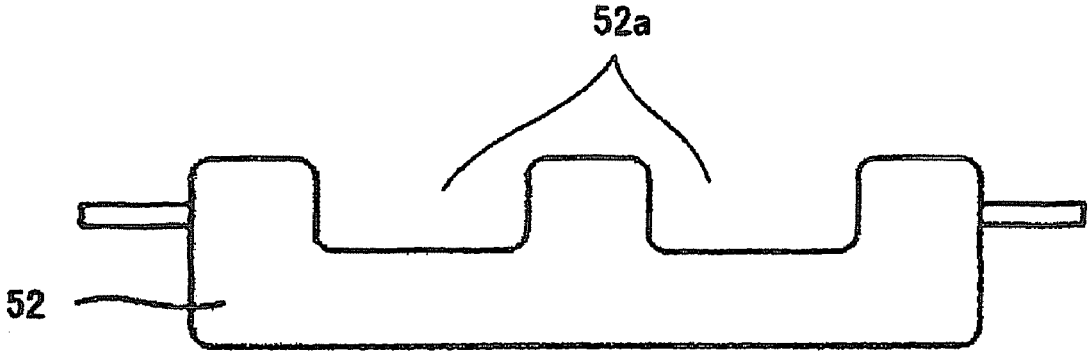
FIG. 11 is a schematic plan view showing a rotary guide according to the first modification of the invention.
Figure 12A:
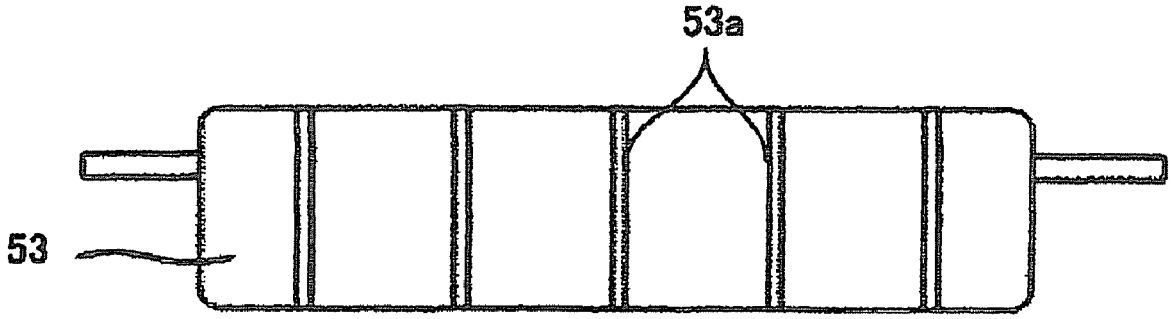
FIGS. 12A and 12B are a plan view and a side view showing a rotary guide according to a second modification of the invention.
Figure 12B:
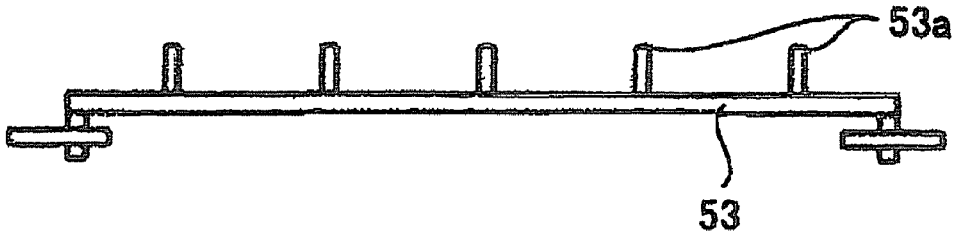

Incidentally, the invention is not limited to the aforementioned embodiments and can be changed without departure from the gist of the invention. For example, the material, structure, etc. of the adjustment member can be decided desirably. As represented by a first modification shown in FIG. 11, a rotary guide 53 having notches 52*a* may be used in place of the rotary guide shaped like a flat plate in the first embodiment. As represented by a second modification shown in FIGS. 12A and 12B, a rotary guide 53 having ribs 53*a* may be used instead. Further, the adjustment member may be made of an elastic substance so that the spring used in the first or second embodiment can be dispensed with.

Figure 13A:
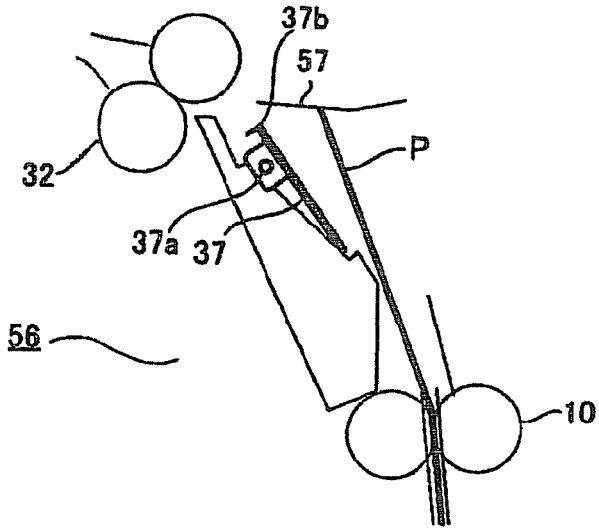
Figure 13B:
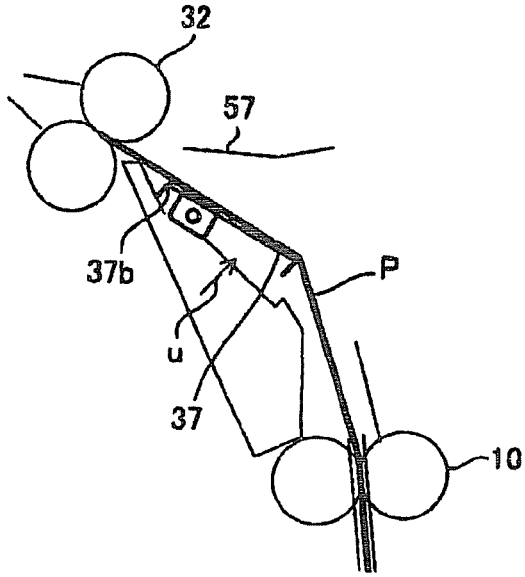

Arrangement of the first and second conveyance members and hence the shape of the guide etc. are not limited. For example, the same effect as described above can be obtained even when a guide 56 with a larger curvature than the guide 33 in first embodiment is provided as represented by a third modification shown in FIGS. 13A and 13B. Incidentally, when the curvature of the guide 56 is large, the sheet P does not come into contact with the rotary guide 37 at the time of contact with a stationary guide 57 as shown in FIG. 13A. However, the sheet P then contacts with the free end 37*b* of the rotary guide 37 to rotate the rotary guide 37 in a direction of an arrow u while the sheet P is moving toward the registration rollers 32 along the stationary guide 57. Thus, as shown in FIG. 13B, the angle of approach of the sheet P to the nip portion between the registration rollers 32 is changed so that the sheet P contacts with the almost whole surface of the rotary guide 37 to change the sheet traveling path forcedly to thereby increase the curvature of the concavely curved inner face of the sheet P. When the sheet P then collides with the nip portion between the suspended registration rollers 32, vibration is absorbed by the warp of the sheet P and the contact between the sheet P and the rotary guide 37 to thereby suppress collision noise to a small value.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet conveyance device comprising:

a first conveyance member configured to convey a sheet in a first direction;

a second conveyance member configured to convey the sheet in a second direction;

a guide disposed between the first conveyance member and the second conveyance member, the guide having a curved face configured to guide the sheet conveyed from the first conveyance member to the second conveyance member; and an adjustment member disposed at an inner position of the curvature of the curved face of the guide, the adjustment member being configured to swing to contact with a curved inner face of the sheet guided by the guide, increasing curvature of the sheet to change an angle of approach to the second conveyance member in accordance with a contact force applied by the adjustment member, wherein the adjustment member slides toward a direction opposite to a sheet conveyance direction by the guide to thereby change the curvature of the curved inner face of the sheet.

2. The device of claim 1, wherein the adjustment member rotates to protrude toward the guide to thereby change the curvature of the curved inner face of the sheet.

3. The device of claim 1, wherein the second conveyance member comprises a pair of registration rollers configured to suspend the sheet from being conveyed and resume the conveyance of the sheet toward an image forming section where an image is formed on the sheet.

4. An image forming apparatus comprising:

an image forming section configured to form an image on a sheet; and a sheet conveyance device comprising:

a first conveyance member configured to convey the sheet in a first direction;

a second conveyance member configured to convey the sheet in a second direction;

a guide disposed between the first conveyance member and the second conveyance member, the guide having a curved face configured to guide the sheet conveyed from the first conveyance member to the second conveyance member; and an adjustment member disposed at an inner position of the curvature of the curved face of the guide, the adjustment member being configured to swing to contact with a curved inner face of the sheet guided by the guide, increasing curvature of the sheet to change an angle of approach to the second conveyance member in accordance with a contact force applied by the adjustment member, wherein the adjustment member slides toward a direction opposite to a sheet conveyance direction by the guide to thereby change the curvature of the curved inner face of the sheet.

5. The apparatus of claim 4, wherein the adjustment member rotates to protrude toward the guide to thereby change the curvature of the curved inner face of the sheet.

6. The apparatus of claim 4, wherein the second conveyance member comprises a pair of registration rollers configured to suspend the sheet from being conveyed and resume the conveyance of the sheet toward an image forming section where an image is formed on the sheet.

* * * * *